US007777124B2

(12) United States Patent
Kawamura

(10) Patent No.: US 7,777,124 B2
(45) Date of Patent: Aug. 17, 2010

(54) MUSIC REPRODUCING PROGRAM AND MUSIC REPRODUCING APPARATUS ADJUSTING TEMPO BASED ON NUMBER OF STREAMING SAMPLES

(75) Inventor: Masafumi Kawamura, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 692 days.

(21) Appl. No.: 11/785,136

(22) Filed: Apr. 16, 2007

(65) Prior Publication Data

US 2007/0261539 A1 Nov. 15, 2007

(30) Foreign Application Priority Data

May 1, 2006 (JP) ..... 2006-127199

(51) Int. Cl.
*G10H 7/00* (2006.01)

(52) U.S. Cl. ..... 84/612; 84/636

(58) Field of Classification Search ..... 84/612, 84/636

See application file for complete search history.

(56) References Cited

U.S. PATENT DOCUMENTS 5,054,360 A * 10/1991 Lisle et al. ..... 84/645
5,300,725 A * 4/1994 Manabe ..... 84/609
6,281,424 B1 * 8/2001 Koike et al. ..... 84/636
6,600,097 B2 * 7/2003 Shiiya ..... 84/609
7,080,016 B2 * 7/2006 Miyashita et al. ..... 704/278
7,518,053 B1 * 4/2009 Jochelson et al. ..... 84/609
2004/0254660 A1 * 12/2004 Seefeldt ..... 700/94
2008/0011149 A1 * 1/2008 Eastwood et al. ..... 84/612
2009/0178542 A1 * 7/2009 Jochelson et al. ..... 84/609

FOREIGN PATENT DOCUMENTS

JP 2003-280662 10/2003

* cited by examiner

*Primary Examiner*—Jeffrey Donels
(74) *Attorney, Agent, or Firm*—Nixon & Vanderhye P.C.

(57) ABSTRACT

A CPU of a game machine compares the predicted number of samples in a streaming reproduction and the actual number of samples during execution of the reproduction of sequence data of the BGM in a step S41 in response to a beat signal detected in a step S35. When the compared error is positive, it is considered that the reproduction of sequence data of the BGM lags behind to increase a tempo of the sequence data reproduction in a step S47. When the error is negative, it is considered that the MIDI reproduction leads to decrease the tempo of the sequence data reproduction in a step S49.

9 Claims, 7 Drawing Sheets

MUSIC REPRODUCING PROGRAM AND MUSIC REPRODUCING APPARATUS ADJUSTING TEMPO BASED ON NUMBER OF STREAMING SAMPLES

CROSS REFERENCE TO RELATED APPLICATION

The disclosure of Japanese Patent Application No. 2006-127199 is incorporated herein by reference.

TECHNICAL FIELD

The exemplary embodiments disclosed herein relate to a music reproducing program and a music reproducing apparatus. More specifically, the exemplary embodiments disclosed herein relate to a music reproducing program and a music reproducing apparatus which simultaneously performs music reproduction by performing a sequence control on a sound source by MIDI data and music reproduction by streaming data which records an actual music playing, etc., in a BGM of the game, etc.

The reproducing system of a BGM (background music) in a video game as a background is roughly divided into two kinds including a streaming reproduction system and a sequence reproduction system. The streaming reproduction system is a system of taking a tune as an audio file as it is and sequentially reading and reproducing it from media, and, being the same as that of the CD. The sequence reproduction system is a system of typically utilizing sequence data such as MIDI sequence data, and comprising a tune on a game machine while sequentially playing a sound source (musical instrument) on the basis of the sequence data.

In the streaming reproduction system, there is an advantage of reproducing a tune with a high-quality sound since the tune can be elaborated in advance on the DAW (Desktop Audio Workstation), for example, while there is a disadvantage of making it difficult to change the tune on the program basis. In the sequence reproduction system, the music playing information can be operated on the program basis, and this makes it possible to change the tune in correspondence with the progress of the game (change musical instruments, add/delete a playing truck, separate the tune to the specific position, etc.). However, since in the sequence reproduction system, due to limits of the processing speed of the game apparatus, it is impossible to utilize a process to be executed in elaborating in advance the tune on the DAW, such as an effector process, incorporation of a long lengths of audio (vocal, etc.), and so on, being less sound quality than that in the streaming reproduction system.

By combining these systems, it is possible to represent a variety of tunes with high sound quality. However, when the music reproductions are performed in both of the streaming system and the sequence system, a time lag of the playing time occurs between them. This is due to the following reason.

The sequence reproduction process is performed on the basis of a program, and causes a slight error from the predicted reproduction tempo due to the accumulation of a slight error of a clock of the processor, an error in executing the program. If a loop is formed in the waveform to be reproduced in the streaming reproduction process, in order to neatly connect the loop at a precise timing, the loop point has to be adjusted such that a position having a waveform sample value of 0 is selected so as to be connected with the loop, for example. However, in doing so, a slight time lag from the original tempo may occurs by the amount of error between the accurate loop position in terms of time and the position having a sample value of 0. In addition, in a case a streaming BGM having the same playing length as a sequence BGM is produced, a human work is required, causing room for human error. Then, the lag of the playing time due to these reasons is most obvious in playing such a long tune, or making a loop reproduction of a tune many times.

On the other hand, with typical DAW software, it is possible to produce music by bringing the streaming data recording an actual music playing into synch with the sequence data.

Furthermore, in the technique covered in a related art 1 (Japanese Patent Laying-open No. 2003-280662 [G10H7/02 1/00]), the audio data recorded in a Hard disk and the MIDI data recorded in a magnetic disk are reproduced according to a clock output from a clock generation portion, capable of synchronizing the audio data and the MIDI data.

However, the typical DAW software adopts an advanced synchronization method in which tempo information is extracted from the audio data to decide a tempo with respect to the MIDI data, or a technique such as a time stretch is utilized so as to conform the audio data to the MIDI data in length. In such an aspect of requiring a tempo synchronization in real time, such as a game, a high processing load to the computer occurs, and an advanced process taking a sound quality into account, such as the time stretch technique is not very necessary.

Also, in the technique covered in the related art 1, since the music is reproduced in response to the clock output from the clock generation portion, it is necessary to separately set the clock in advance in a game, and the like, resulting in preparation for more data.

BACKGROUND AND SUMMARY

Therefore, a feature of certain exemplary embodiments is to provide a novel storage medium of a music reproducing program and music reproducing apparatus which simultaneously performs a music reproduction by a sequence system and by a streaming system.

Another feature of certain exemplary embodiments is to provide a storage medium of a music reproducing program and a music reproducing apparatus which is able to play a tune (BGM) by adjusting a tempo of a sequence reproduction with respect to a streaming reproduction to thereby allow music (BGM) playing combining superior parts of the both playing systems.

A further feature of certain exemplary embodiments is to provide a storage medium of a music reproducing program and a music reproducing apparatus which is able to synchronize a sequence reproduction to a streaming reproduction at a low processing load.

A first exemplary embodiment is a music reproducing program for a music reproducing apparatus having a storing means, a music streaming data reproducing means and a sound source means, and is a music reproducing program which causes a computer of the music reproducing apparatus to execute a streaming reproducing step for reproducing a music from the music streaming data reproducing means on the basis of streaming data stored in the storing means in response to a music reproducing start instruction, a sequence reproducing step for reproducing a music from the sound source means on the basis of predetermined sound source sequence data and tempo stored in the storing means in response to the music reproducing start instruction, a streaming reproduction lapse detecting step for detecting a lapse of reproduction at a time of the streaming reproducing step in the sequence reproducing step, and a tempo adjusting step for adjusting a tempo in the sequence reproducing step depending on the lapse of reproduction detected in the streaming reproduction lapse detecting step.

In the first exemplary embodiment, a music reproducing apparatus (12: reference numeral designating a portion corresponding in the exemplary embodiments) includes a storing means (40), a music streaming reproducing means (36, 62, 66), and a sound source means (52, 54, 62, 66), and a computer (36). The computer (36) reproduces a music on the basis of the streaming data stored in the storing means in response to a music reproducing start instruction (S7: FIG. 4), and reproduces a music from the sound source means on the basis of the predetermined sound source sequence data and tempo stored in the storing means in response to the music reproducing start instruction (FIG. 6, FIG. 7). The computer (36) detects a lapse of reproduction at a time of the streaming reproducing step during execution of the sequence reproducing step (S37, S39), and adjusts the tempo by the detected lapse of reproduction (S41-S49).

According to the first exemplary embodiment, the tempo of the sequence reproduction is adjusted with respect to the streaming reproduction, capable of playing a tune (BGM) combining superior parts of the both playing systems (reproducing system).

A second exemplary embodiment relates to the music reproducing program of the first exemplary embodiment, in which the sequence reproducing step further includes a reference timing signal detecting step for detecting a reference timing signal, and the streaming reproduction lapse detecting step includes a sample count predicting step for obtaining a predicted value of the number of reproduction samples in the streaming reproducing step in response to the reference timing signal, and a reproduction sample count obtaining step for obtaining the number of reproduction samples on the basis of an actual streaming reproduction in the streaming reproducing step in response to the reference timing signal.

In the second exemplary embodiment, when detecting a reference timing signal such as a beat signal in a reference timing signal detecting step (S35), the computer (36) detects the predicted number of reproduction samples and the actual number of reproduction samples in the streaming reproduction as a lapse of reproduction in response thereto.

According to the second exemplary embodiment, a lapse of reproduction in the streaming reproduction, that is, the actual number of reproduction samples and the predicted number of samples are detected in response to a timing signal in the sequence reproduction, such as a beat signal, and therefore, it is possible to synchronize the both without a complex control.

A third exemplary embodiment is a music reproducing program according to the second exemplary embodiment, wherein the tempo adjusting step includes an error calculating step for calculating an error between the predicted value and the number of reproduction samples, and a tempo increasing and decreasing step for increasing and decreasing the tempo in the sequence reproducing step on the basis of the error.

In the third exemplary embodiment, the computer (36) executes an error calculating step (S41) to increase and decrease the tempo on the basis of the error (S45, S47, S49).

According to the third exemplary embodiment, the tempo is increased or decreased on the basis of the compared error between the actual number of reproduction samples and the predicted number of samples, capable of performing a precise synchronizing control at a low processing load.

A fourth exemplary embodiment is a music reproducing program of the third exemplary embodiment, in which the tempo increasing and decreasing step modifies the tempo according to a rate of change of the tempo having a nonlinear relationship depending on the magnitude of the error.

According to the fourth exemplary embodiment, the computer (36) brings the error amount into correspondence with the rate of change in the nonlinear relationship.

According to the fourth exemplary embodiment, the rate of change of the tempo is made to a nonlinear form depending on the error amount, and therefore, it is possible to converge for a large error amount.

A fifth exemplary embodiment is a music reproducing apparatus which comprises a sound source means, a storing means for storing sound source control sequence data and a tempo for controlling the sound source means, and music streaming data, a streaming reproducing means for reproducing a music on the basis of the streaming data stored in the storing means in response to a music reproducing start instruction, a sequence reproducing means for reproducing a music from the sound source means on the basis of the sound source control sequence data and the tempo stored in the storing means in response to the music reproducing start instruction, a streaming reproduction lapse detecting means for detecting a lapse of reproduction in the streaming reproducing means, and a tempo adjusting means for adjusting the tempo of the sequence reproduction by the sequence reproducing means according to the lapse of reproduction.

In the fifth exemplary embodiment, it is possible to anticipate the same advantage as that of the first exemplary embodiment.

According to certain exemplary embodiments, the tempo of the sequence reproduction is adjusted with respect to the streaming reproduction, capable of playing a tune (BGM) combining superior parts of the both playing systems (reproducing system).

The above described features, aspects and advantages of certain exemplary embodiments will become more apparent from the following detailed description when taken in conjunction with the accompanying drawings.

DETAILED DESCRIPTION

Figure 1:
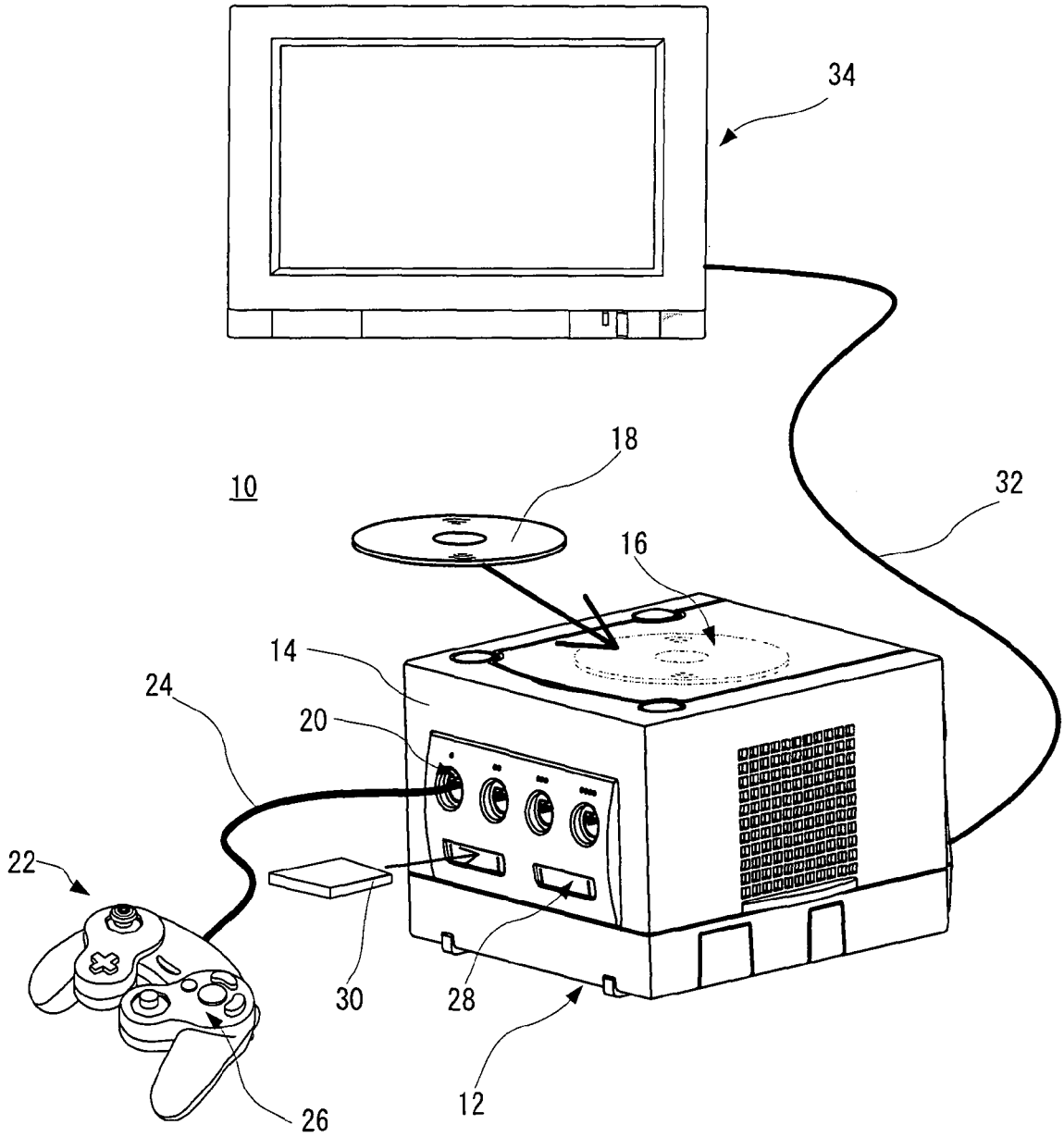
FIG. 1 is an illustrative view showing a game system of an exemplary embodiment.

A video game system 10 shown in the FIG. 1 exemplary embodiment includes a video game machine (hereinafter to simply be referred to as "game machine") 12. A music reproducing program is applied to the game machine 12 in this exemplary embodiment, and in that sense, the game machine 12 is also a music reproducing apparatus.

The game machine 12 includes an approximately cubic housing 14, and on an upper surface of the housing 14, an optical disk drive 16 is provided. An optical disk 18 which is one example of an information storage medium storing a game program is loaded on the optical disk drive 16. The housing is provided with a plurality of connectors 20 (four in this exemplary embodiment) on a front surface thereof. These connectors 20 are for connecting a controller 22 to the game machine 12 by a cable 24, and can connect up to four controllers in this exemplary embodiment to the game machine 12.

The controller 22 is provided with an operating means (control) 26 on its upper, lower, lateral sides and etc. The operating means 26 includes, for example, two analog joysticks, one cross key, a plurality of button switches, and so on. One analog joystick is utilized for inputting a moving direction and/or a moving speed, a moving amount and etc. of a player character (may be referred to as "player object") (moving image character or object operable with the controller 22 by the player) according to an amount and a direction of an inclination of the stick. The other analog joystick is utilized for controlling movement of a virtual camera according to a direction of an inclination thereof. The cross switch is utilized for instructing the moving direction of the player character in place of the analog joystick. The button switches are utilized for instructing movement of the player character, switching a point of view of the virtual camera in a three-dimensional image, adjusting the moving speed of the player character, and so on. The button switches further control a menu selection and movement of a pointer or a cursor, for example.

It is noted that the controller 22 is connected to the game machine 12 by a cable 24 in this exemplary embodiment. However, the controller 22 may be connected to the game machine 12 by other methods, such as wirelessly connected via an electromagnetic wave (e.g., radio wave or infrared ray). Furthermore, detailed structure of the operating means of the controller 22 is, of course, not limited to the structure of the described exemplary embodiment and can be arbitrarily changed or modified. For example, the only one analog joystick may be utilized, or no analog joystick may be utilized. The cross switch may not be utilized.

At least one (two, in this exemplary embodiment) memory slot 28 is provided below the connectors 20 on the front surface of the housing 14 of the game machine 12. A memory card 30 is inserted to this memory slot 28. The memory card 30 is utilized for loading the game program, the display data read from the optical disk 18 and temporarily store it, or saving game data (e.g., result of a game) of the game that the player plays by utilizing the game system 10.

The housing 14 of the game machine 12 is, on a rear surface thereof, provided with an AV cable connector (not shown) with which a monitor 34 is connected to the game machine 12 through an AV cable 32. The monitor 34 is typically a color television receiver, and the AV cable 32 inputs a video signal from the game machine 12 to a video input terminal of the color television and applies a sound signal to a sound input terminal. Accordingly, a game image of a three-dimensional (3D) video game, for example, is displayed on a screen of the color television (monitor) 34, and a stereo game sound, such as a game music (BGM), a sound effect, etc. is output from right and left speakers.

In the game system 10, a user or a game player turns on a power source of the game machine 12 in order to play a game (or another application), and then, selects a suitable optical disk 18 storing software (data) of a video game (or another application intended to play), and loads the optical disk 18 on the disk drive 16 of the game machine 12. In response thereto, the game machine 12 starts to execute the video game or another application on the basis of the software stored in the optical disk 18. The user operates the controller 22 so as to apply an input to the game machine 12. For example, in response to an operation of any one of the operating means 26, the game or another application is started. By moving another of the operating means 26, it is possible to move the moving image character (player character) toward a different direction and to change the point of eye of the user (camera location) in the three-dimensional (3D) game world.

The optical disk 18 records the game data as described above, such the game data includes game program data and game image data representing a player character (player object) appearing in the game and the other non-player characters (background character, enemy character, etc.). The game data further includes streaming data (PCM data, for example) for reproducing a game music (BGM) in a streaming reproduction system.

It should be noted that sequence data for sequentially controlling a sound source means described later includes an MIDI message, for example, and such sequence data is included in a sound processing program being a part of the above-described program.

Figure 2:
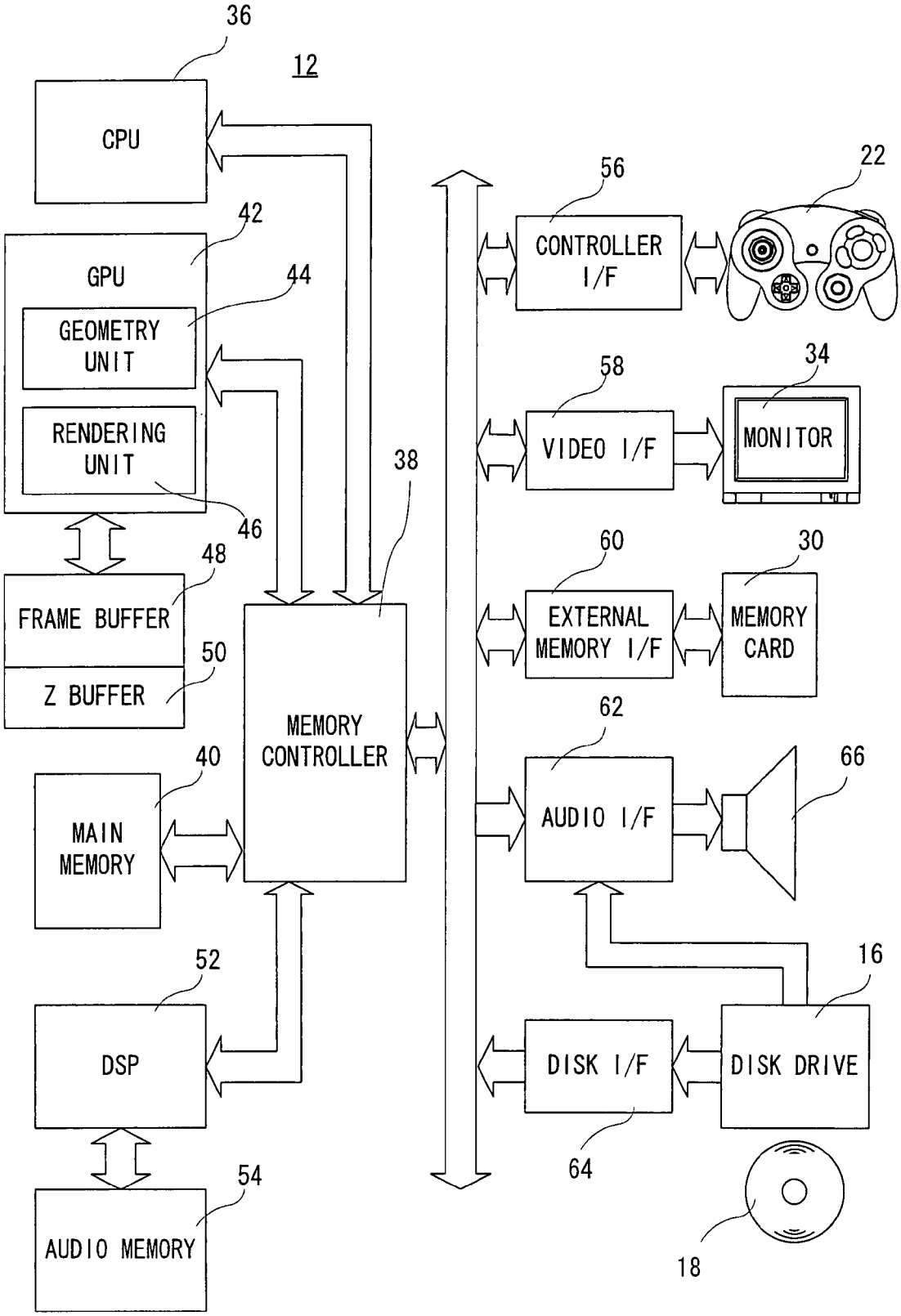
FIG. 2 is a block diagram showing a detail of the game machine in the FIG. 1 exemplary embodiment.

FIG. 2 is a block diagram comprising the video game system 10 in FIG. 1 exemplary embodiment. The game machine 12 is provided with a central processing unit (hereinafter, may be referred to as "CPU") 36 which takes charge of overall control of the game machine. The CPU 36 is connected with a memory controller 38 via a bus. The memory controller 38 mainly controls writing and reading into and from a main memory 40 connected via a bus under control of the CPU 36. The memory controller 38 is coupled with a GPU (Graphics Processing Unit) 42.

The GPU 42 is constructed by a single chip ASIC, for example, receives a graphics command from the CPU 36 via the memory controller 38, and generates the three-dimensional (3D) game image by a geometry unit 44 and a rendering unit 46 in response to the command. That is, the geometry unit 44 performs a coordinate operation process such as turnaround or rotation, movement, transformation and etc. of a variety of characters and objects (which is formed by a plurality of polygons, and the polygon is a polygonal plane defined by at least three vertex coordinates) in a three-dimensional coordinates system. The rendering unit 46 pastes (performs a rendering) a texture (Texture: pattern image) on each of polygons of a variety of objects. Accordingly, three-dimensional image data to be displayed on the game screen is produced by the GPU 42, and the image data is rendered (stored) in a frame buffer 48. It should be noted that data (primitive or polygon, texture, etc.) required to execute the graphics command by the GPU 42 is acquired from the main memory 40 via the memory controller 38.

The frame buffer 48 is a memory for rendering (accumulating) one frame of the image data of the raster scan monitor 34, for example, and is rewritten by the GPU 42 at every frame. A video I/F 58 described later reads the data stored in the frame buffer 48 through the memory controller 38, whereby a 3D game image can be displayed on the screen of the monitor 34. It is noted that a capacity of the frame buffer 48 is a size corresponding to the number of pixels (or dots) of a screen intended to be displayed, has the number of pixels (storing position or address) of the display or the monitor 34, for example.

Furthermore, a Z buffer 50 has a storage capacity equal to "the number of pixels (storing position or address) corresponding to the frame buffer 48×the number of bits of depth data per one pixel", and stores depth information or depth data (Z value) of the dots corresponding to the respective storing positions of the frame buffer 48.

It should be noted that both of the frame buffer 48 and the Z buffer 50 may be constructed by a portion of the main memory 40.

The memory controller 38 is also connected to an audio memory 54 via a DSP (Digital Signal Processor) 52. Accordingly, the memory controller 38 controls writing and/or reading of the audio memory 54 as well as the main memory 40. The sound source means (MIDI sound source) comprises the DSP 52 and the audio memory 54. That is, in the audio memory 52, waveform data corresponding to a tone color of musical instruments (keyboard instruments such as a piano, string instruments such as a violin, aerophone such as a trumpet and a flute, percussion instrument, percussion, etc.) to be output from the sound source means and other various tone colors, and the DSP 52 processes the waveform data on the basis of the sequence data (MIDI message, typically) to output it as music data (audio data). The music data or audio data to be output from the sound source means is temporarily stored in the frame memory 48 along with the image data by the memory controller 38, and then applied to an audio I/F 62 described later from the frame memory 48.

The memory controller 38 is further connected with respective interfaces (I/F) 56, 58, 60, 62 and 64 by busses. The controller I/F 56 is an interface for the controller 22, and applies an operation signal or data of the operating means 26 of the controller 22 to the CPU 36 through the memory controller 38. The video I/F 58 accesses the frame buffer 48 so as to read the image data created by the GPU 42 and applies the image signal or the image data (digital RGB pixel value) to the monitor 34 via the AV cable 32 (FIG. 1). The external memory I/F 60 couples the memory card 30 (FIG. 1) to be inserted on the front surface of the game machine 12 with the memory controller 38. This allows the CPU 36 to write and read data to and from the memory card 30 via the memory controller 38. The audio I/F 62 receives the audio data applied from the frame buffer 48 through the memory controller 38 or audio stream data read from the optical disk 18 (actually, streaming buffer to be described later formed in an appropriate position of the main memory 40) and applies an audio signal (sound signal) corresponding thereto to the speakers 66 of the monitor 34. It is noted that in a case of the stereo sound, the speaker 66 is provided at right and left at least one. Then, the disk I/F connects the disk drive 16 with the memory controller 38 to allow the CPU 36 to control the disk drive 16. Program data, texture data, etc. read from the optical disk 18 by the disk drive 16 are written to the main memory 40 under the control of the CPU 36.

Figure 3:
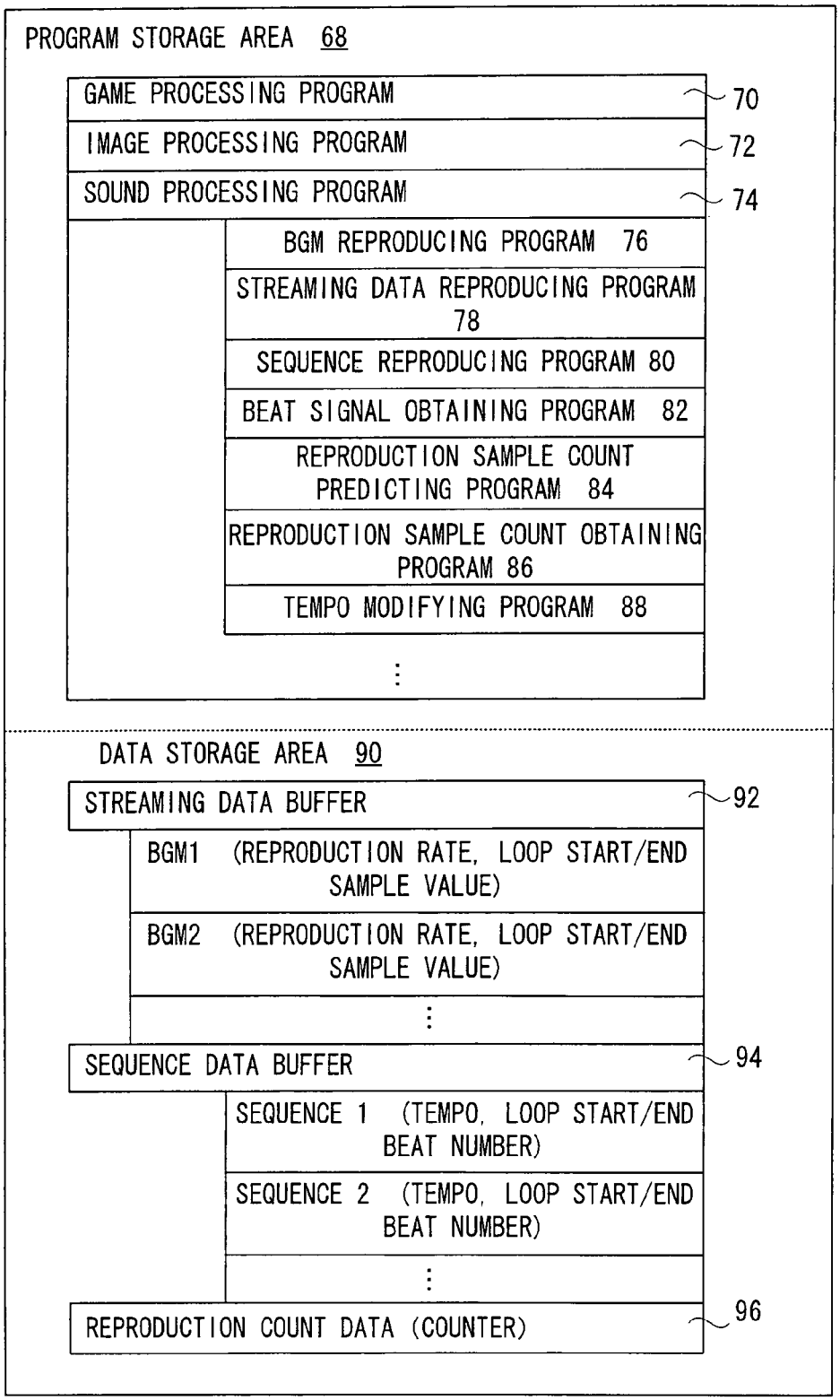
FIG. 3 is an illustrative view showing one example of a memory map of a main memory in the FIG. 2.

FIG. 3 shows a memory map of the main memory 40. The main memory 40 includes a program storage area 68. The program storage area 68 includes a game processing program area 70, an image processing program area 72, and a sound processing program area 72. In the game processing program area 70, the game program read from the optical disk 18 is stored entirely at a time or partially and sequentially. In the image processing program area 72, similarly, the game program data read from the optical disk 18 is stored entirely at a time or partially and sequentially. The image processing program data is a program for causing a player character to move within a game space or make another arbitrary action in response to the game player operating the controller 38.

Figure 4:
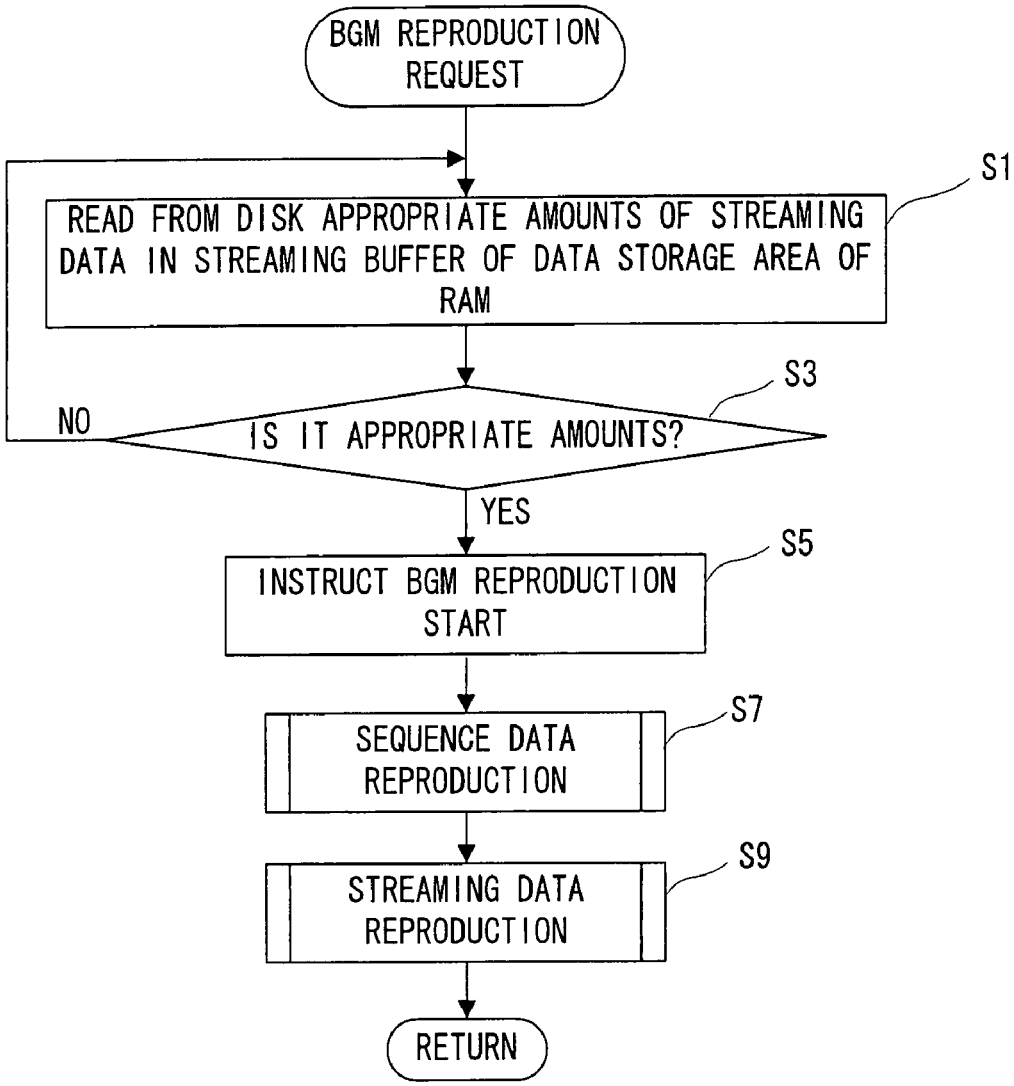
FIG. 4 is a flowchart showing a BGM reproducing operation of the FIG. 1 exemplary embodiment.

In the sound processing program area 74 included in the program storage area 68, a BGM reproducing program 76 for reproducing a game music (BGM) is formed. One example of the BGM reproducing program 76 is shown by the flowchart shown in FIG. 4 described later. The sound processing program area 74 further includes a streaming data reproducing program 78 illustrated in the flowchart FIG. 5 described later and a sequence reproducing program 80 illustrated in the flowchart in FIG. 6 and FIG. 7 described later.

As to the sequence reproducing program 80, a beat signal obtaining program 82, a reproduction sample count predicting program 84, a reproduction sample count obtaining program 86, a tempo modifying program 88, etc are provided.

The beat signal obtaining program 82 is a program for obtaining a beat signal for each beat in a sequence reproduction. That is, this method is for imbedding the information per beat in the sequence data, and generating a beat signal when there is the information in the course of the sequence. Another method is conceived of determining a lapse of one beat when a tick of a specified interval is processed on the basis of the number of ticks (system resolution per unit of time for processing the MIDI sequence data) and the beat information of the tune, and thereby generating a beat signal.

The streaming waveform data stored in the streaming buffer is sequentially subjected to a sound generation process in the audio I/F 62, but the number of samples being subjected to the sound generation process is the number of reproduction samples. The reproduction sample count predicting program 84 is a program for predicating the number of streaming waveform samples to be reproduced at that time at a timing when a beat signal is generated, and the reproduction sample count obtaining program 86 is a program for obtaining the actual number samples reproduced in the streaming system at a timing when the beat signal is generated.

The main memory 40 is formed with a data storage area 90 which includes a streaming buffer 92, a sequence data buffer 94, and a reproduction count data counter 96. In the streaming buffer 92, the streaming data read from the optical disk 18 is stored as described above. The streaming data is stored as a series of data for each music (BGM), and represented as BGM1, BGM2, . . . , here. The streaming data includes a reproduction rate (frequency) indicating a velocity of reproduction of the streaming data, a start sample value and an end sample value in a loop reproduction (repeat reproduction), etc. as well as waveform data. The loop start sample value means a sample value (address) from which the loop starts, and the loop end sample value means a sample value (address) at which the loop ends.

In the sequence data buffer 94, sequence data extracted from the sound processing program 74 is stored. The sequence data is stored as a series of data for each music, and represented as a sequence 1, a sequence 2, . . . , here. The sequence data includes an MIDI message (data inclusively addressing an instruction command to the sound source and a control command of the playing). The sequence data includes an MIDI message as a fundamental form, a loop command utilized by extending the MIDI message, and further includes a start beat number and an end beat number for a loop playing. The loop starting beat number means the beat number when the loop starts, and the loop ending beat number means the beat number when the loop ends, in the sequence reproduction.

The sequence data further includes tempo data, and does not synchronize with a processing frame of the game and the sample rate of the streaming data in the MIDI reproduction. In the sequence data, first, it is well known that a count value (tick) is defined as a basis (quarter note is equal to 480 ticks, for example). The tempo data is data to define how many seconds one tick is. Accordingly, the tempo data is finally synonymous with a musical tempo indicating the number of counts of the quarter note per minute.

It should be noted that the reproduction count data counter 96 counts the number of ticks on the basis of the above-described tempo data. That is, how many seconds one tick is decided on the basis of the tempo data, and therefore, the count value, that is, the number of ticks is counted on the basis of the tempo.

In a game playing, when the optical disk 18 is set on the game machine 12, and the power supply is turned on as described above, data is read from the optical disk, and a program and data necessary in a game map and a stage at that time are stored (loaded) in the main memory 40 as shown in FIG. 3. The game is executed according to the program and the data, but the exemplary embodiments described herein have nothing to do with the game itself, and therefore, a description of the game will be omitted.

The CPU 36 receives a BGM (game music) reproduction request by the game program during execution of the game. In response thereto, the CPU 36 reads appropriate amounts of streaming data capable of quickly start reproducing from the disk 18 to the streaming buffer 92 (FIG. 3) of the main memory 40 in a first step S1 in FIG. 4. Then, when the appropriate amounts of streaming data are read in the streaming buffer 92, the CPU 36 instructs a reproduction start of the BGM in a step S5. That is, when it is determined that the sufficient amounts of streaming data is accumulated in the streaming buffer in a step S3, a BGM reproduction starting instruction is issued in the step S5. In the streaming reproduction, a time lag for reading the streaming data (waveform data) of the main memory (RAM) 40 from a recording medium, that is, a disk 18 occurs, and therefore, the sequence reproduction is held until the required amounts of waveform data is accumulated in the streaming buffer 92. In a step S7, the sequence data reproduction is executed in response to the reproduction starting instruction in synchronization with the streaming reproduction. The streaming reproduction and the sequence reproduction are started at the same time, but the both are separately described for the sake of convenience in the below description.

Figure 5:
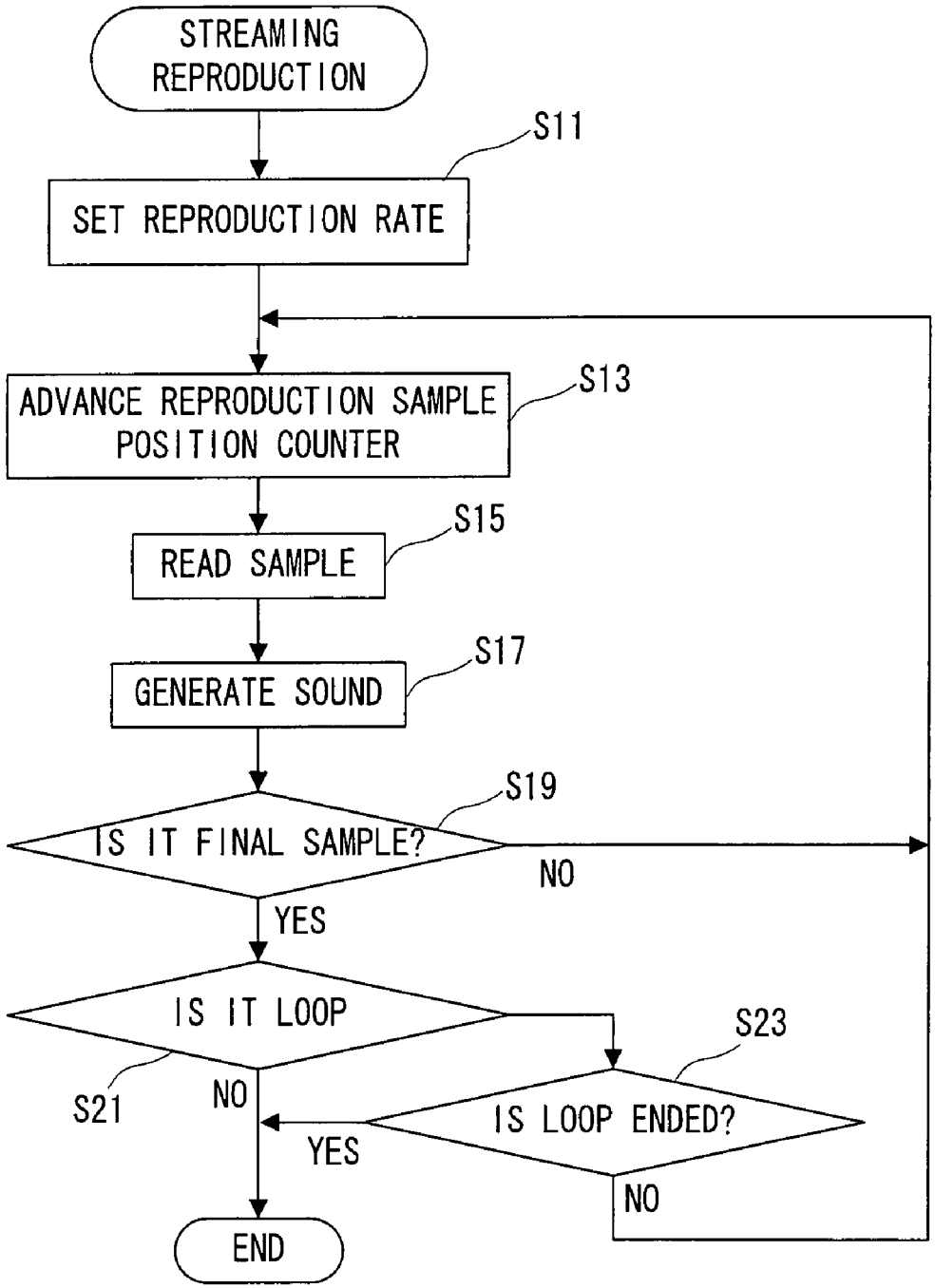
FIG. 5 is a flowchart showing a streaming reproduction operation in the FIG. 1 exemplary embodiment.

The streaming data reproduction is shown in detail in FIG. 5. In the streaming reproduction, the streaming data is sequentially read from the recording medium 18 so as not to make the streaming buffer 92 empty, that is, so as to constantly accumulate the appropriate amounts of streaming data. However, it is first pointed out that this is omitted in FIG. 5.

Then, in a first step S11, the CPU 36 reads a reproduction rate included in the streaming data (BGM) stored in the streaming buffer 92 to decide the tempo (rate) at that time in the streaming data reproduction. Then, a reproduction sample position counter (not illustrated) formed in an appropriate position of the data storage area 90 in the main memory 40, for example, is incremented in a step S13, a streaming sample (waveform data) is read from the streaming buffer 92 in a step S15, and the waveform data is input to the audio I/F 62 (FIG. 2) to thereby generate a sound in a step S17. That is, in the streaming reproduction, the steps S13-S17 are repeatedly executed until the final sample value is detected in a step S19 to sequentially transmit the streaming waveform data accumulated in the streaming buffer 92 to the sound generation process. At this time, the number of streaming waveform samples (the number of samples) being subjected to the sound generation process is detected or counted according to the reproduction sample count obtaining program 86 in FIG. 3.

When the final sample value is detected in the step S19, it is determined whether or not the streaming BGM is to be subjected to the loop reproduction in a step S21. For the streaming BGM to be subjected to the loop reproduction, since the loop start/end sample value is set in advance in the streaming buffer 92 in FIG. 3, viewing allows a determination between "YES" and "NO" in the step S21. If the loop reproduction is not required, the process directly ends.

Then, if the loop reproduction is performed, that is, if "YES" is determined in the step S21, it is determined whether or not the loop is to be ended in a succeeding step S23. A condition of the loop end is when the number of loops set in advance is reached, as one example. Every time that the loop is repeated, the loop counter (not illustrated) set in an appropriate position of the data storage area of the main memory 40, for example, is incremented to thereby count the number of loops. On the other hand, the number of times of the loop reproduction (the number of loops) is set in the buffer 92*a* as a part of the streaming data, and therefore, in the step S23, it is determined whether or not the previous number of loops counted by the loop counter reaches the number of loops set in the buffer.

Another condition to end the loop is when an instruction signal for forcibly ending the streaming BGM is output as a result of progress of the game, etc. By the end instruction signal, the loop is ended, and "YES" is determined in the step S23.

If it is determined that the loop is not ended ("NO") in the step S23, the process in the steps S13-S25 is repeatedly executed.

Thus, the streaming reproduction is executed, and during the execution, the number of reproduction samples is counted or detected as described above.

It should be noted that in a case that whether or not a loop reproduction is made wants to be determined on the basis of the program, the processes in the above-described step S19 and step S21 may be interchanged. In this case, when the end point of the loop section has come, if the flag "to be looped" (not illustrated) which is set in an appropriate area of the data storage area 90 of the main memory 40, for example, is set, the loop is executed, and if not, the process is jumped. Then, if the final sample has come in the reproducing, the process is ended.

Figure 6:
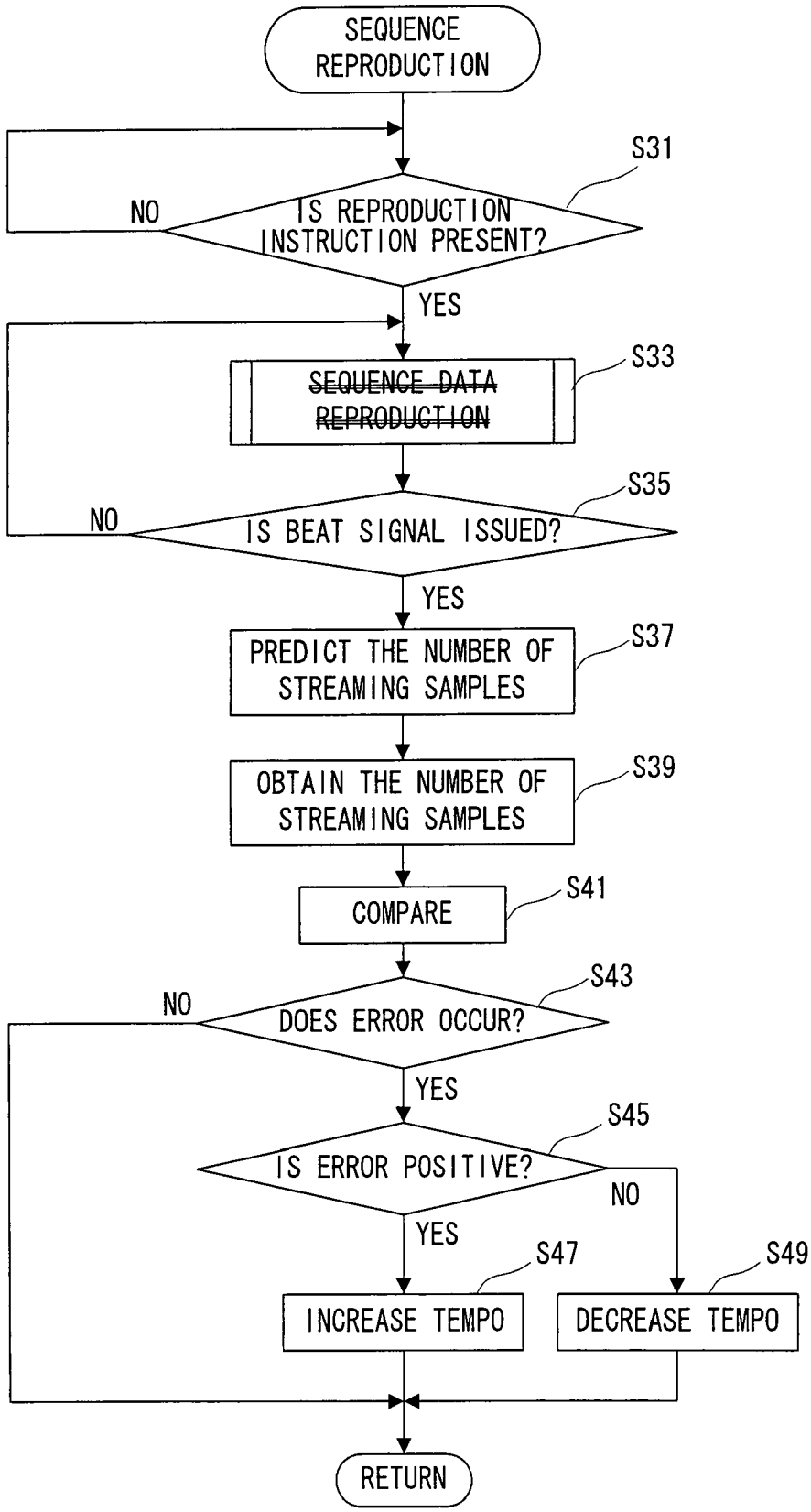
FIG. 6 is a flowchart showing a sequence reproduction operation in the FIG. 1 exemplary embodiment.

Next, referring to FIG. 6 and FIG. 7, a description will be made on the sequence reproduction. The sequence reproduction cannot be started before the sequence reproduction instruction is issued from the streaming reproduction program in order to synchronize with the streaming reproduction as described before. Then, when the reproduction instruction is received in a step S31, reproduction of the sequence data is executed in a succeeding step S33.

Figure 7:
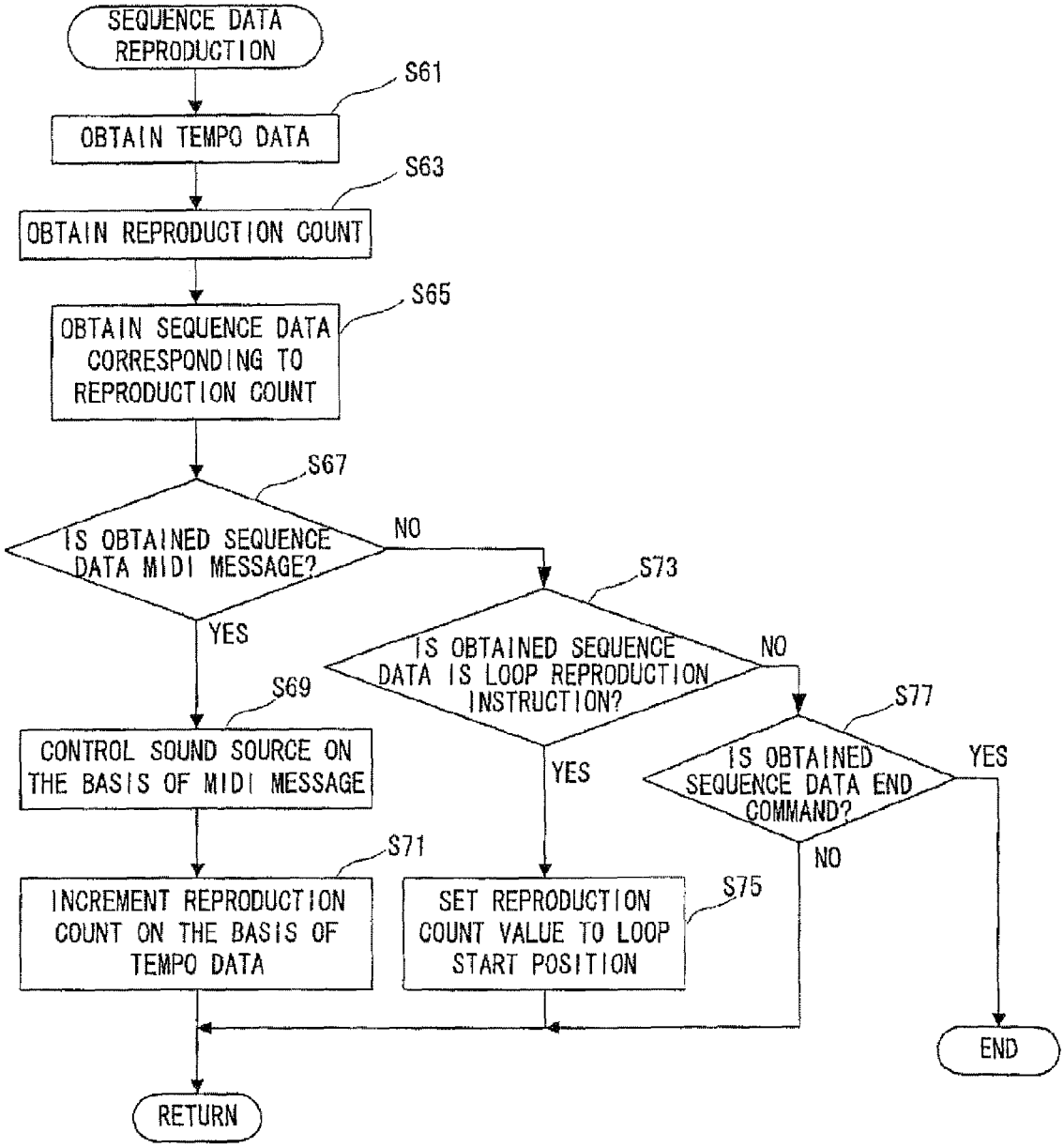
FIG. 7 is a flowchart showing a data reproducing operation in the FIG. 6 exemplary embodiment.

In the sequence data reproduction, as shown in FIG. 7, the CPU 36 obtains the tempo data from the sequence buffer 94 of the data storage area 90 shown in FIG. 3 in a first step S61. On the one hand, in a step S63, the CPU 36 obtains the reproduction count data from the reproduction count data counter 96 of the data storage area 94. The reproduction count means the number of ticks. Then, in a step S65, the CPU 36 fetches the sequence data corresponding to the reproduction count, that is, the number of ticks from the sequence data buffer 94.

In a next step S67, the CPU 36 determines whether or not the sequence data obtained in the step S65 is an MIDI message. The MIDI message means a command for informing the DSP 50 (FIG. 2) of a sound pitch (musical scale), generation (NoteOn: sound generation start timing) and end (NoteOff: sound generation end timing) of a sound and loudness (intensity) of a sound, and the sequence data includes the command and the control command of the playing. Accordingly, if "YES" is determined in the step S67, the CPU 36 sends the MIDI message to the DSP 50 in a step S69. Then, the DSP 50 processes the sound source waveform in the audio memory 52 (FIG. 2) according to the instruction command to output it as music data (audio data). By the audio data, the audio I/F 62 outputs an audio signal to the speaker 66, which generates a sound.

Next, in a step S71, the CPU 36 increments the reproduction count data counter 96 on the basis of the tempo data. That is, how many times one tick takes is determined depending on the tempo (how many quarter notes (480 tick)) is within one minute, and therefore, whether or not reproduction count (tick) is advanced (incremented) is determined not by the processing frame but the tempo.

It should be noted that if "NO" in the step S67, the CPU 36 determines whether or not the sequence data obtained in the step S65 is a loop reproduction instruction in a next step S73. In the game machine like the exemplary embodiment, a command is produced by extending a basic sequence message, and here, it is determined whether or not the loop reproduction command is included in the sequence data. When the sequence data includes the loop command, in a next step S75, the CPU 36 sets the count value of the loop starting position in the reproduction count data counter 96.

It should be noted that when it is determined the sequence data obtained in the step S65 includes an end command in a step S77, the sequence reproduction is ended. Thus, in the step S33 shown in FIG. 6, the sequence data reproduction is executed.

In a next step S35, the CPU 36 determines whether or not a beat signal is issued. The beat signal is detected according to the beat signal obtaining program 82 as described before. The beat signal functions as a reference timing signal for detecting a lag of the streaming reproduction at that time, and other reference timing signals may be utilize besides the beat signal if at all possible.

When detecting the beat signal in the step S35, the CPU 36 predicts the number of streaming waveform samples which is to be reproduced at that time or should have been reproduced at that time according to the reproduction sample count predicting program 84 (FIG. 2) in a next step S37. More specifically, according to the Equation 1, the number of reproduction samples at that time can be predicted by multiplying the number of samples per beat determined on the basis of the reproduction rate of the streaming reproduction by the number of beat signals which has already been obtained at that time.

predicted value of the number of reproduction samples=the number of samples per beat×the number of beat signals [Equation 1]

Next, the CPU 36 obtains the actual number of reproduced streaming samples which has been counted during execution of the streaming reproduction shown in FIG. 5 in a step S39.

In a step S41, according to the Equation 2, by comparing the predicted value of the number of reproduction samples of the streaming waveform and the actual value, an error is evaluated.

error=the actual number of reproduction samples−the predicted number of reproduction samples [Equation 2]

Then, it is determined whether an error occurs in a step S43, and no error means that the streaming BGM reproduction and the sequence BGM reproduction at that time are synchronized with each other. Accordingly, in this case, the process is directly returned without making anything.

If an error is detected in the step S43, the CPU 36 determines whether or not the error is positive in a next step S45.

If the error is positive, this means that the predicted value lags, that is, the sequence BGM lags behind the streaming BGM, and in a following step S47, the CPU 36 increases the tempo of the sequence. On the contrary thereto, if the error is negative, the predicted value leads, that is, the sequence BGM leads the streaming BGM, and therefore, in a step S49, the CPU 36 decreases the tempo of the sequence BGM. It should be noted that in order to increase and decrease the tempo, the numerical value of the rate of change (percentage change) is set. That is, an increase rate to increase the tempo or a reduction rate to reduce the tempo is set, and the time for counting the number of ticks is changed for every 480 tick (quarter note) so as to be inversely proportional to the increase rate or the reduction rate to thereby gradually synchronize the sequence reproduction and the streaming reproduction.

It should be noted that the above-described rate of change can be set such that it changes depending on the magnitude of the error. For example, if the rate of change of the tempo is prepared as a quadratic curve (rate of change having a non-linear relationship) with respect to the error amount, when the error is large, the tempo is significantly changed (significantly reduced), and the convergence of the error speeds up.

The sequence reproduction is a method of sequentially combining the sequence data, and therefore, by slightly adjusting the reproducing tempo of the sequence as described above, it is possible to easily synchronize the sequence reproduction with the streaming reproduction.

It should be noted that as such a method of slightly adjusting a tempo, it is thought that the error as described above is reduced for every tick, and an error reducing process is executed by a unit of a process of the game, but in the exemplary embodiment, an error reducing process is executed every beat signal of the sequence reproduction without adopting these methods. This is due to the following reason. That is, performing too frequent error reducing processes places an excessive load on the game processing as an original work of the game machine, but by performing the tempo adjustment for every beat, the tempo change is naturally audible to human ears.

It should be noted that for the loop reproduction, as described above, besides the number of samples per beat information, the information of the start sample value and the end sample value of the loop of the streaming BGM and the information of the loop starting beat number and the loop ending beat number of the sequence BGM are included, and whereby, it is possible to accurately make a calculation if the loop is repeated.

Thus, it is possible to synchronize the sequence BGM and the streaming BGM, and therefore, it is possible to play the tune (BGM) by combining superior parts of the both playing systems. For example, a playing truck by the sequence BGM can be added to the streaming BGM with the high-quality sound. Also, by making the most part of the playing part in the streaming format, the sequence playing process (sequence analyzing process and waveform combining process) can be omitted, capable of reducing a share of the CPU and the DSP imposed in the sequence reproduction.

Furthermore, if the sequence data is taken as the game chronologically controlling data, it is possible to control an event and an object in the game in completely synchronization with the streaming BGM.

Although certain exemplary embodiments have been described and illustrated in detail, it is clearly understood that the same is by way of illustration and example only and is not to be taken by way of limitation, the spirit and scope of these certain exemplary embodiments being limited only by the terms of the appended claims.

What is claimed is:

1. A storage medium which stores a music reproducing program for a music reproducing apparatus having a storage, a music streaming data reproducer, and a sound source, said program causes a computer of said music reproducing apparatus to execute:

a streaming reproducing step for reproducing music from said music streaming data reproducer on the basis of streaming data stored in said storage in response to a music reproducing start instruction;

a sequence reproducing step for reproducing music from said sound source on the basis of predetermined sound source sequence data and tempo stored in said storage in response to said music reproducing start instruction;

a streaming sample number detecting step for detecting the number of streaming samples at a time of said streaming reproducing step in said sequence reproducing step; and a tempo adjusting step for adjusting the tempo in said sequence reproducing step depending on said number of streaming samples detected in said streaming sample number detecting step.

2. A storage medium according to claim 1, wherein said sequence reproducing step includes a reference timing signal detecting step for detecting a reference timing signal, and said streaming sample number detecting step includes a sample count predicting step for obtaining a predicted value of the number of reproduction samples in said streaming reproducing step in response to said reference timing signal, and a reproduction sample count obtaining step for obtaining the number of reproduction samples on the basis of the actual streaming reproduction in said streaming reproducing step in response to said reference timing signal.

3. A storage medium according to claim 2, wherein said tempo adjusting step includes an error calculating step for calculating an error between said predicted value and said number of reproduction samples, and a tempo changing step for increasing or decreasing the tempo in said sequence reproducing step on the basis of said error.

4. A storage medium according to claim 3, wherein said tempo changing step modifies the tempo according to a rate of change of the tempo having a nonlinear relationship depending on the magnitude of said error.

5. A music reproducing apparatus, comprising:

a sound source;

a storage which stores sound source control sequence data and a tempo for controlling said sound source, and music streaming data;

a streaming reproducer which reproduces music on the basis of the streaming data stored in said storage in response to a music reproducing start instruction;

a sequence reproducer which reproduces music from said sound source on the basis of the sound source control sequence data and the tempo stored in said storage in response to said music reproducing start instruction;

a streaming sample number detector which detects the number of streaming samples in said streaming reproducer; and a tempo adjuster which adjusts the tempo of the sequence reproduction by said sequence reproducer according to said number of streaming samples.

6. A music reproducing apparatus according to claim 5, wherein said sequence reproducer includes a reference timing signal detector which detects a reference timing signal, and said streaming sample number detector includes a sample count predictor which obtains a predicted value of the number of reproduction samples in response to said reference timing signal in said streaming reproducer, and a reproduction sample count obtainer which obtains the number of reproduction samples on the basis of an actual streaming reproduction in response to said reference timing signal in said streaming reproducer.

7. A music reproducing apparatus according to claim 6, wherein said tempo adjuster includes an error calculator which calculates an error between said predicted value and said number of reproduction samples and a tempo changer which increases or decreases the tempo on the basis of said error in said sequence reproducer.

8. A music reproducing apparatus according to claim 7, wherein said tempo changer modifies the tempo according to a rate of change of the tempo having a nonlinear relationship depending on the magnitude of said error.

9. A storage medium storing a music reproducing program for a music reproducing apparatus having a storage, a music streaming data reproducer, and a sound source, said program causes a computer of said music reproducing apparatus to execute:

reproducing music from said music streaming data reproducer based on streaming data stored in said storage in response to a music reproducing start instruction;

reproducing music from said sound source based on predetermined sound source sequence data and tempo stored in said storage in response to said music reproducing start instruction;

detecting the number of streaming samples when reproducing the music from the music streaming data reproducer; and adjusting the tempo of the music being reproduced depending on the number of streaming samples detected.

* * * * *